US009831549B2

(12) United States Patent
Kroening

(10) Patent No.: US 9,831,549 B2
(45) Date of Patent: Nov. 28, 2017

(54) SYSTEMS AND METHODS FOR HIGH POWER MICROWAVE COMBINING AND SWITCHING

(71) Applicant: Honeywell International Inc., Morristown, NJ (US)

(72) Inventor: Adam M. Kroening, Atlanta, GA (US)

(73) Assignee: Honeywell International Inc., Morris Plains, NJ (US)

( * ) Notice: Subject to any disclaimer, the term of this patent is extended or adjusted under 35 U.S.C. 154(b) by 517 days.

(21) Appl. No.: 14/460,924

(22) Filed: Aug. 15, 2014

(65) Prior Publication Data

US 2016/0049727 A1 Feb. 18, 2016

(51) Int. Cl.

| | |
|---|---|
| ***H01Q 3/00*** | (2006.01) |
| ***H01Q 3/36*** | (2006.01) |
| ***H01Q 3/26*** | (2006.01) |
| ***H01Q 3/28*** | (2006.01) |
| ***H01Q 3/38*** | (2006.01) |
| ***H01Q 21/00*** | (2006.01) |
| *H01Q 3/40* | (2006.01) |
| *H01Q 1/00* | (2006.01) |
| *H01Q 3/24* | (2006.01) |
| *H01Q 25/00* | (2006.01) |

(52) U.S. Cl.

CPC ..... *H01Q 3/36* (2013.01); *H01Q 3/2658* (2013.01); *H01Q 3/28* (2013.01); *H01Q 3/38* (2013.01); *H01Q 21/0006* (2013.01); *H01Q 1/002* (2013.01); *H01Q 3/24* (2013.01); *H01Q 3/40* (2013.01); *H01Q 25/00* (2013.01)

(58) Field of Classification Search

CPC ..... H01Q 3/36; H01Q 3/38; H01Q 3/2658; H01Q 3/28; H01Q 3/40; H01Q 21/0006

USPC ..... 342/372, 373

See application file for complete search history.

(56) References Cited

U.S. PATENT DOCUMENTS

| | | | |
|---|---|---|---|
| 3,255,450 | A | 6/1966 | Butler |
| 3,419,821 | A | 12/1968 | Jones |

(Continued)

FOREIGN PATENT DOCUMENTS

| | | |
|---|---|---|
| EP | 1670092 | 6/2006 |
| EP | 2698870 | 2/2014 |
| JP | 09232865 | 9/1997 |

OTHER PUBLICATIONS

European Patent Office, "Extended European Search Report from EP Application No. 15179909.5 dated Dec. 15, 2015", "from Foreign Counterpart of U.S. Appl. No. 14/460,924", filed Dec. 15, 2015, pp. 1-10, Published in: EP.

(Continued)

*Primary Examiner* — Chuong P Nguyen

(74) *Attorney, Agent, or Firm* — Fogg & Powers LLC

(57) ABSTRACT

Systems and methods for high power microwave combining and switching are provided. In at least one implementation a system includes a plurality of inputs, wherein there are M inputs in the plurality of inputs and a plurality of phase shifters, wherein there are N phase shifters in the plurality of phase shifters and N is a multiple of two times M, wherein a signal received through the plurality of inputs is divided and coupled to N/M phase shifters. The system further includes an N:N Butler matrix coupled between outputs of the N phase shifters in the plurality of phase shifters and a plurality of outputs.

15 Claims, 6 Drawing Sheets

(56) References Cited

U.S. PATENT DOCUMENTS 4,156,243 A * 5/1979 Yorinks ..... H01Q 3/40 343/779
4,827,270 A * 5/1989 Udagawa ..... H01Q 19/17 333/116
4,839,894 A * 6/1989 Rudish ..... H01Q 3/40 333/126
4,924,196 A 5/1990 Uyeda
5,115,248 A * 5/1992 Roederer ..... H01Q 3/2658 342/368
5,134,417 A * 7/1992 Thompson ..... H01Q 25/007 342/373
5,151,706 A * 9/1992 Roederer ..... H01Q 25/00 342/372
5,929,804 A * 7/1999 Jones ..... H01Q 3/40 342/354
5,936,591 A * 8/1999 Yamasa ..... H01Q 3/40 342/373
5,966,048 A * 10/1999 Thompson ..... H03F 1/3223 330/124 R
6,243,038 B1 6/2001 Butler et al.
6,680,698 B2 * 1/2004 Eiges ..... H01Q 1/28 342/361
6,791,507 B2 * 9/2004 Johansson ..... H01Q 1/246 343/754
7,683,731 B2 3/2010 Kroening
8,803,628 B1 8/2014 Kroening
2009/0108930 A1 * 4/2009 Gandhi ..... H03F 3/602 330/124 R
2011/0102263 A1 * 5/2011 Angeletti ..... H01Q 3/40 342/373
2011/0205119 A1 8/2011 Timofeev et al.
2017/0125873 A1 5/2017 Kroening

OTHER PUBLICATIONS

European Patent Office, "Communication pursuant to Article 94(3) EPC from EP Application No. 15179909.5", "from Foreign Counterpart of U.S. Appl. No. 14/460,924", filed Aug. 23, 2016, pp. 1-8, Published in: EP.

Woode et al., "Investigations Into Multipactor Breakdown in Satellite Microwave Payloads", Oct. 30, 1990, pp. 467-478, vol. 14, Publisher: ESA Journal, Published in: Netherlands.

Kroening, "Twist for Connecting Orthogonal Waveguides in a Single Housing Structure", "U.S. Appl. No. 13/948,258, filed Jul. 23, 2013", Jul. 23, 2013, pp. 1-52, Published in: US.

Kroening, "Systems and Methods for Ferrite Circulator Phase Shifters", "U.S. Appl. No. 14/136,592, filed Dec. 20, 2013", Dec. 20, 2013, pp. 1-27, Published in: US.

European Patent Office, "Invitation pursuant to Article 94(3) and Rule 71(1) EPC from EP Application No. 15179909.5 dated Mar. 29, 2017", "from Foreign Counterpart of U.S. Appl. No. 14/460,924", filed Mar. 29, 2017.

* cited by examiner

SYSTEMS AND METHODS FOR HIGH POWER MICROWAVE COMBINING AND SWITCHING

BACKGROUND

In certain implementations, such as space radio frequency and payloads, systems use devices in a high power radio frequency (RF) network that combine inputs and direct the inputs to a particular antenna in a group of antennas. For example, the inputs may be provided by two travelling wave tube amplifiers (TWTAs). In certain applications, when the inputs from multiple TWTAs are combined, the combined power may be too great for a system comprised of ferrite switching circulators. Other implementations use variations of a Butler matrix in combination with a series of phase shifters. The Butler matrices reduce the power that passes through the phase shifters and, in general, are better suited for high power applications. However, when there are less inputs than outputs, the combination of Butler matrices connected to each side of the phase shifters leads to an inefficient combination of couplers.

SUMMARY

Systems and methods for high power microwave combining and switching are provided. In at least one implementation a system includes a plurality of inputs, wherein there are M inputs in the plurality of inputs and a plurality of phase shifters, wherein there are N phase shifters in the plurality of phase shifters and N is a multiple of two times M, wherein a signal received through the plurality of inputs is divided and coupled to N/M phase shifters. The system further includes an N:N Butler matrix coupled between outputs of the N phase shifters in the plurality of phase shifters and a plurality of outputs.

DRAWINGS

Understanding that the drawings depict only exemplary embodiments and are not therefore to be considered limiting in scope, the exemplary embodiments will be described with additional specificity and detail through the use of the accompanying drawings, in which.

Figure 1:
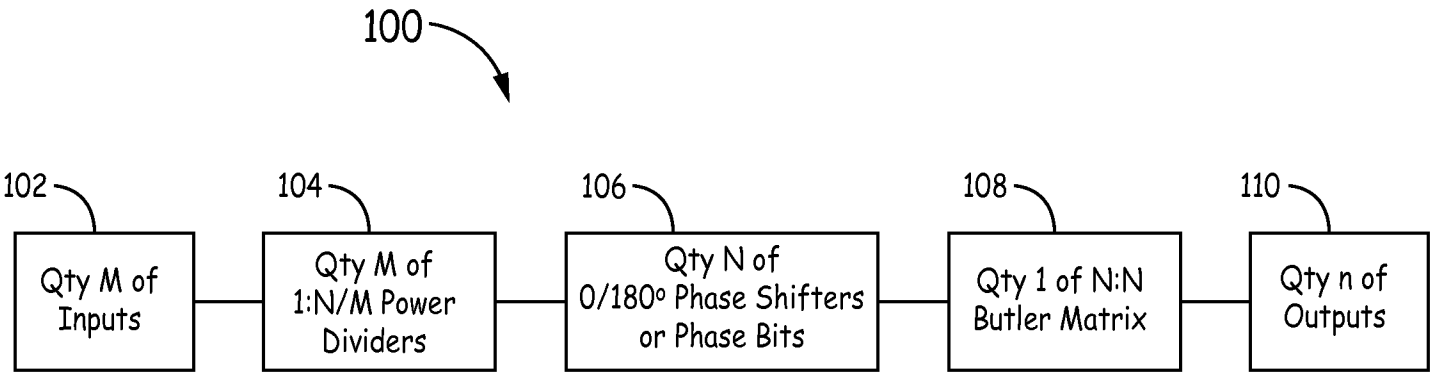
FIG. 1 is a block diagram of a system for high power microwave combining and switching in one embodiment described in the present disclosure.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. Furthermore, the method presented in the drawing figures and the specification is not to be construed as limiting the order in which the individual steps may be performed. The following detailed description is, therefore, not to be taken in a limiting sense.

Embodiments described in this application are drawn to systems and methods for high power microwave combining and switching that more efficiently uses couplers when providing received energy to a series of phase shifters. To increase the efficiency of the couplers when there are at least twice as many outputs as inputs, signals received from an input are distributed to a subset of the phase shifters, where there are the same number of phase shifters as outputs. The outputs of the phase shifters are each connected to an input of a Butler matrix. Then, depending on the phase of the signals and the configuration of the phase shifters, signals that are received through the inputs of the system can be directed and combined so that all the power received through the inputs is directed to a particular output.

FIG. 1 is a block diagram illustrating a system 100 for combining and switching according to one embodiment. Specifically, the system 100 combines and routes signals received through M inputs 102 to one or more of N outputs. The system 100 may be used as part of a high power radio frequency (RF) network. In at least one implementation, the system 100 receives inputs from M travelling wave tube amplifiers (TWTAs). After combining the M inputs, the system 100 may direct all or a portion of the power towards one or more of the N outputs. In one exemplary implementation, the N outputs are connected to separate antennas and the system 100 may be used in RF networks that use beam hopping techniques or beam forming techniques as understood by one having skill in the art.

In embodiments described herein, when routing the M inputs to the N outputs, the system 100 may be constrained by certain conditions in order to implement the system 100. In one implementation, the number of inputs and outputs of the system may be constrained such that the number of inputs M is greater than 1 and less than or equal to the number of outputs N divided by 2 ($1<M\leq N/2$). Further, the number of inputs M may be constrained to being an even number. Also, the number of outputs N may be constrained to the nearest power of 2 that is greater than the actual number of outputs used from the system 100. For example, if the system 100 connects to six antennas, the system 100 will provide eight outputs, where six of the eight outputs are connected to the six antennas and the other two outputs are terminated with a load.

In certain embodiments, to combine the different signals received through the M inputs, the system 100 first passes the M inputs through different sets of power dividers 104. As described herein, the system 100 includes M different 1:N/M power dividers 104. In one exemplary implementation, in a system with sixteen outputs and having 4 inputs, each input is connected to a 1:(16/4) or 1:4 power divider. In a similar manner, a system with 8 outputs and having 4 inputs, would have 1:2 power dividers. Where the system has 1:N/M power dividers, each power divider receives one input and divides the power between N/M different outputs.

In at least one embodiment, the M power dividers are coupled to N different phase shifters 106. The phrase "phase shifter", as used herein, refers to a device that is used to change the transmission phase angle of a signal in a network. As used in the system 100, the phase shifters 106 may be controllable to either a reference phase state of 0° or a phase state 180° different from the reference 0° state. Therefore, when RF energy flows through a phase shifter, it undergoes a change in the phase of a signal by either 0° or 180° degrees of relative phase shift. Each phase shifter 106 may be controllable by another device that determines its shift and provides a signal to the desired phase shifter in the phase shifters 106. Further, each phase shifter 106 receives a portion of the power received by the M power dividers. For example, an input may supply power through a power divider to four different phase shifters 106. When the power divider provides power to four different phase shifters 106, the power divider divides the power of the received signal from an associated input such that each connected phase shifter 106 receives the signal at substantially the same power. For example, when there are four phase shifters connected to a single power divider, each phase shifter 106 may receive the signal at a quarter of the original power.

Further, each phase shifter in the N phase shifters 106 functions as one of the inputs to an N:N Butler Matrix 108. As used herein, the Butler matrix 108 refers to a matrix in RF networks and may be used for beam-forming and other Transmission technologies. It generally is characterized by having N inputs and N outputs, where N is a multiple of 2. Further, the Butler matrix 108 includes multiple couplers, such as 3 dB couplers that couple the inputs to one or more of the outputs depending on the configuration of the phase shifters 106. In particular, the phase shifters 106 may be configured to control which output or outputs receive the signals from the Butler matrix 108.

In at least one implementation, the outputs of the Butler matrix 108 are coupled to a series of antenna elements. In one example, there are N antenna elements coupled to the N outputs 110 of the Butler matrix 108. Alternatively, there may be less than N antenna elements coupled to the N outputs 110 of the Butler matrix 108. When there are less than N antenna elements coupled to the N outputs 110 of the Butler matrix 108, outputs 110 that are not coupled to an antenna element may be coupled to a matched load to absorb signals that are transmitted to the output. Further any unnecessary couplers within the Butler matrix 108 may be removed when 1 or more of the outputs are terminated by a matched load.

As described above, the use of M 1:(N/M) power dividers between the inputs and the phase shifters allows the combining/switching system 100 to be fabricated using less couplers and fewer crossing waveguides. By using less couplers, the system 100 is able to consume less space while still being able to handle high power signals, such as signals provided by multiple TWTAs.

Figure 2:
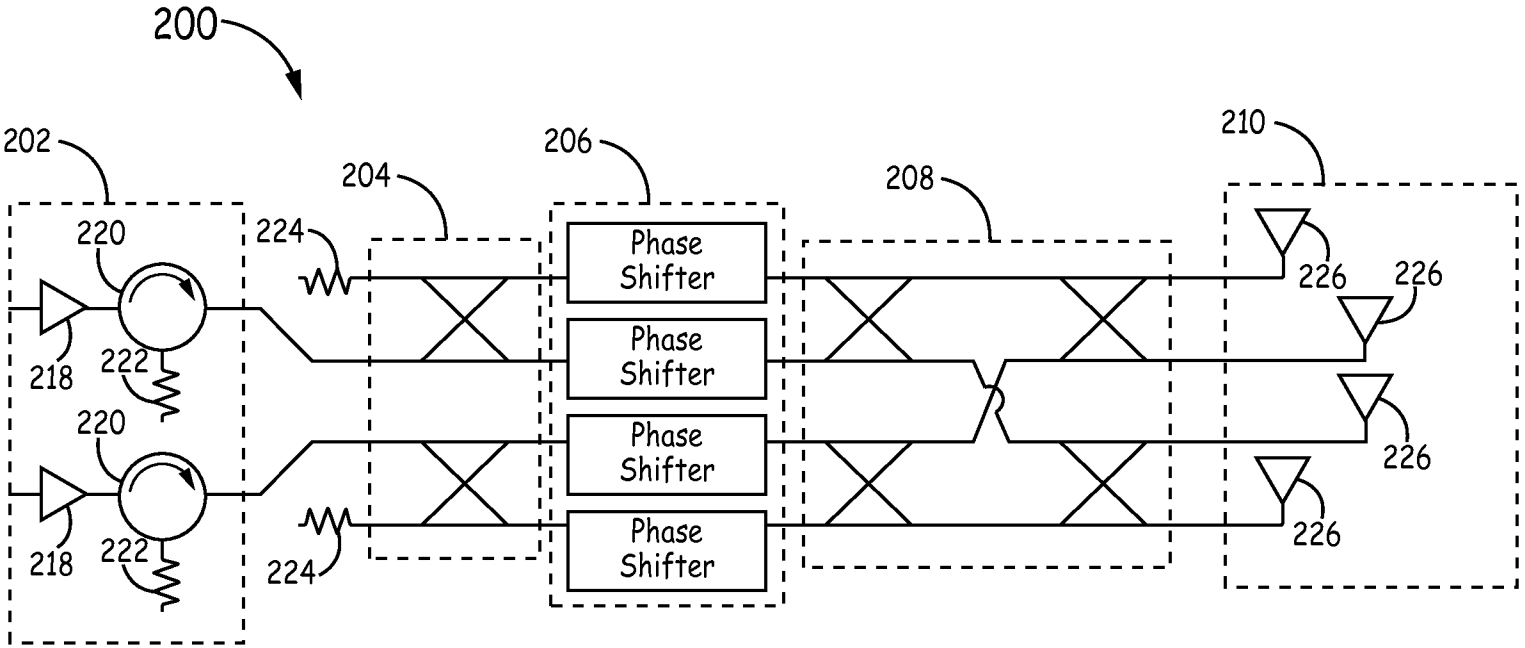
FIGS. 2-5 are schematic diagrams of different systems for high power microwave combining and switching in various embodiments described in the present disclosure.

FIGS. 2-5 provide exemplary implementations of the system 100 having different combinations of inputs and outputs. For example, FIG. 2 is a schematic illustrating a combining/switching system 200 having two inputs and four outputs. Thus, as compared to system 100, M=2 and N=4. Further, system 200 includes inputs 202, power dividers 204, phase shifters 206, Butler matrix 208, and outputs 210, which are exemplary implementations of inputs 102, power dividers 104, phase shifters 106, Butler matrix 108, and outputs 110 as described above in relation to system 100 in FIG. 1.

In certain implementations, the system 200 receives two inputs 202 from separate TWTAs 218. Each output of each TWTA 218 is connected to a ferrite circulator 220, which circulates the signal towards the power dividers 204. Each input 202 is connected to a power divider 204 that divides the signal into two different branches. Each branch from the power divider 204 connects to N/M different phase shifters. As N=4 and M=2, the power dividers 204 each divide the power from a single input 202 and provide the divided power to two separate phase shifters 206. As illustrated, to divide the power from the input into two different phase shifters, each power divider 204 comprises a single 3 dB coupler. As illustrated, the 3 dB couplers each have one connection terminated with a load 224. In a similar manner, the circulators 220 also have a connection terminated with a load 222. The loads 222 and 224 may be matched loads that absorb signals to prevent the reflection of signals within the combining/switching system 200.

Further, the phase shifters 206 may be configurable to control the phase shift to be either 0 or 180 degrees. As understood by one having skill in the art, by controlling the shifts performed by the phase shifters 206, the system 200 is able to control the manner in which the different signals combine within the Butler matrix 208. By controlling how the signals combine in the Butler matrix 208, the signals can be routed to a particular output 210. Wherein the different outputs may each be connected to antennas 226. Thus, the phase shifters 206 and Butler matrix 208, after receiving the different signals from the power dividers 204, are able to combine and/or switch signals received from the inputs 202 towards a particular output 210. By routing the different signals, the system 200 may be used for beam-forming and other system implementations.

Figure 3:
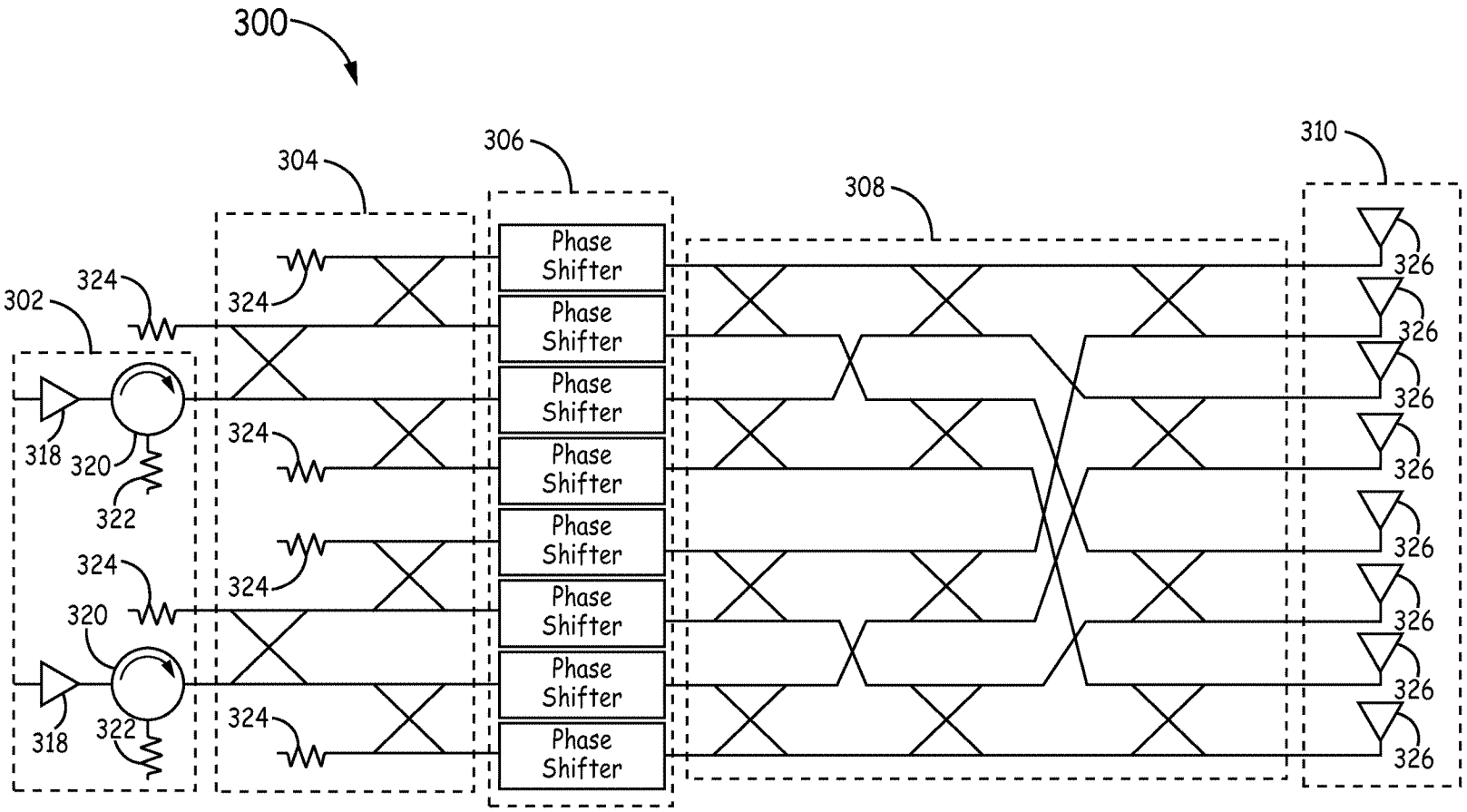

FIG. 3 is a schematic illustrating a combining/switching system 300 having two inputs and eight outputs. Thus, as compared to system 100, M=2 and N=8. Further, system 300 includes inputs 302, power dividers 304, phase shifters 306, Butler matrix 308, and outputs 310, which are exemplary implementations of inputs 102, power dividers 104, phase shifters 106, Butler matrix 108, and outputs 110 as described above in relation to system 100 in FIG. 1.

In certain implementations, the system 300 receives two inputs 302 from separate TWTAs 318. Each output of each TWTA 318 is connected to a ferrite circulator 320, which circulates the signal towards the power dividers 304. Each input 302 is connected to a power divider 304 that divides the signal into four different branches. Each input to the power dividers 304 connects to N/M different phase shifters. As N=8 and M=2, the power dividers 304 each divide the power from a single input 302 into four signals and provide the signals having the divided power to four separate phase shifters 306. As illustrated, to divide the power from an input into four different phase shifters, each power divider 304 comprises three 3 dB couplers. To divide a single input into four outputs, a circulator 320 provides an input into a single 3 dB coupler, which divides the input into two different outputs for the 3 dB coupler. Each of the outputs is then provided to a separate 3 dB coupler which further divides the signal from two inputs to four outputs, where each of the four outputs is provided to a separate phase shifter in the phase shifters 306. As shown there are two sets of power dividers 304, where each set of power dividers 304 is associated with a different input 302. As further illustrated, each of the 3 dB couplers in power dividers 304 have one connection terminated with a load 324. In a similar manner, the circulators 320 also have a connection terminated with a load 322. The loads 322 and 324 may be matched loads that absorb signals to prevent the reflection of signals within the combining/switching system 300. As shown in FIG. 3, the arrangement of power dividers 304, where power from one of the two inputs is only divided to four of the eight phase shifters 306 permits the use of less 3 dB couplers when compared to a system that divides the power from each input amongst all of the different phase shifters 306, as would be the typical case when employing an input 8×8 Butler Matrix.

In a further implementation, the phase shifters 306 may be configurable to control the phase shift to be either 0 or 180 degrees. As understood by one having skill in the art, by controlling the shifts performed by the phase shifters 306, the system 300 is able to control the manner in which the different signals combine within the 8×8 Butler matrix 308. By controlling how the signals combine in the Butler matrix 308, the signals can be routed to a particular output 310. Wherein the different outputs 310 may each be connected to antennas 326. Thus, the phase shifters 306 and Butler matrix 308, after receiving the different signals from the power dividers 304, are able to combine and/or switch signals received from the inputs 302 towards a particular output 310 in a 2 to 8 combining and switching matrix.

Figure 4:
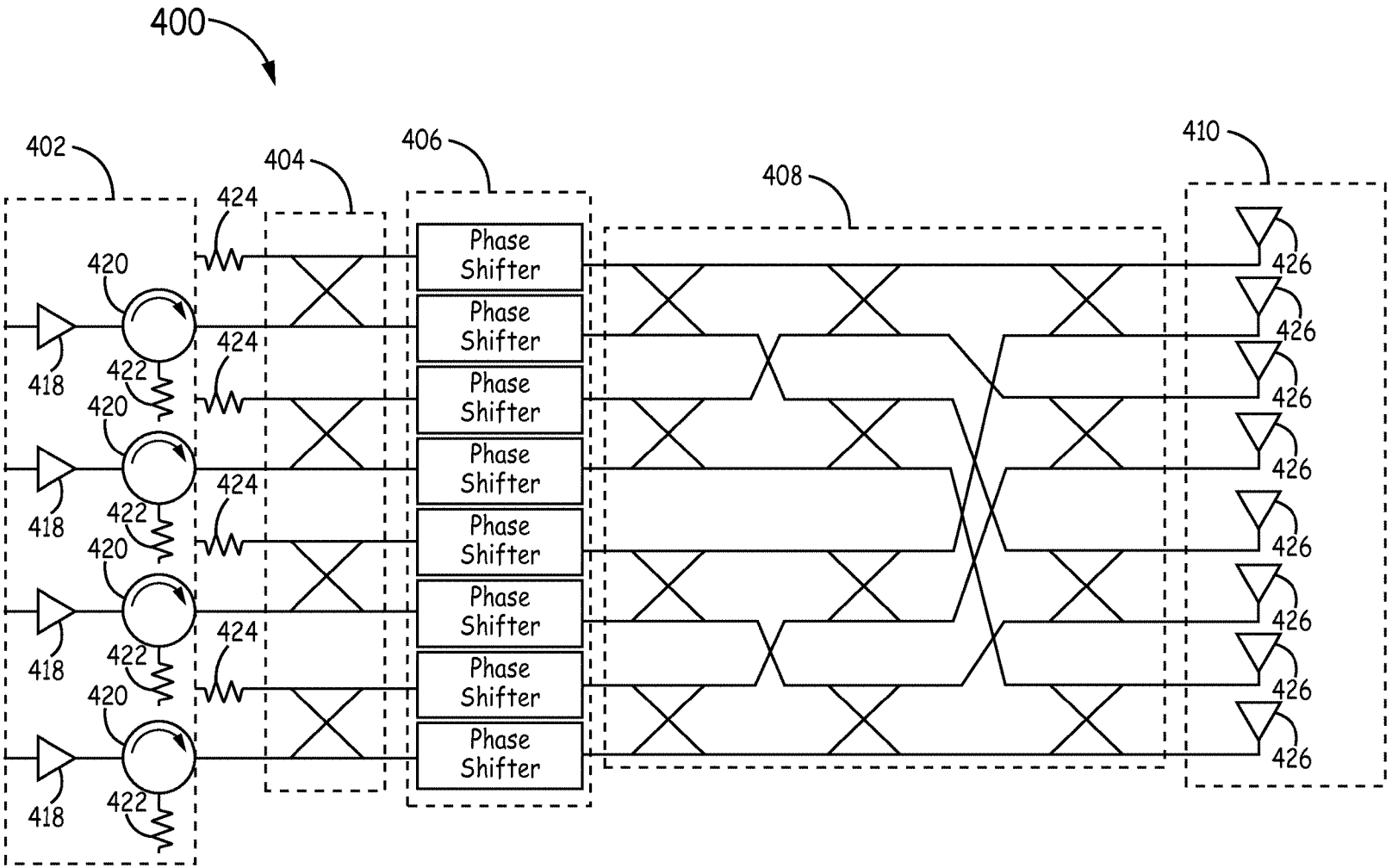

FIG. 4 is a schematic illustrating a combining/switching system 400 having four inputs and eight outputs. Thus, as compared to system 100, M=4 and N=8. Further, system 400 includes inputs 402, power dividers 404, phase shifters 406, Butler matrix 408, and outputs 410, which are exemplary implementations of inputs 102, power dividers 104, phase shifters 106, Butler matrix 108, and outputs 110 as described above in relation to system 100 in FIG. 1.

In certain implementations, the system 400 receives four inputs 402 from four different TWTAs 418. Each output of each TWTA 418 is connected to a ferrite circulator 420, which circulates the signal towards the power dividers 404. Each input 402 is connected to a power divider 404 that divides the signal into two different branches in a similar manner as described with relation to power dividers 204 in FIG. 2. Each input to the power divider 404 connects to N/M different phase shifters. As N=8 and M=4, the power dividers 404 each divide the power from a single input 402 into two signals and provide the signals having the divided power to two different phase shifters 406. As shown there are four sets of power dividers 404, where each set of power dividers 404 is associated with a different input 402. As further illustrated, each of the 3 dB couplers in the power dividers 404 have one connection terminated with a load 424. In a similar manner, the ferrite circulators 420 also have a connection terminated with a load 422. The loads 422 and 424 may be matched loads that absorb signals to prevent the propagation of reflected signals within the combining/switching system 400. As shown in FIG. 4, the arrangement of power dividers 404, where power from one of the four inputs is only divided to two of the eight phase shifters 406 permits the use of less 3 dB couplers when compared to a system that divides the power from each input amongst all of the different phase shifters 406.

In a further implementation, the phase shifters 406 may be configurable to control the phase shift to be either 0 or 180 degrees. As understood by one having skill in the art, by controlling the shifts performed by the phase shifters 406, the system 400 is able to control the manner in which the different signals combine within the 8×8 Butler matrix 408 in a similar manner as described above in relation to the 8×8 Butler matrix 308 in FIG. 3. By controlling how the signals combine in the Butler matrix 408, the signals can be routed to a particular output 410. Wherein the different outputs 410 may each be connected to antennas 426. Thus, the phase shifters 406 and Butler matrix 408, after receiving the different signals from the power dividers 404, are able to combine and/or switch signals received from the inputs 402 towards a particular output 410 in a 4 to 8 combining and switching matrix.

Figure 5:
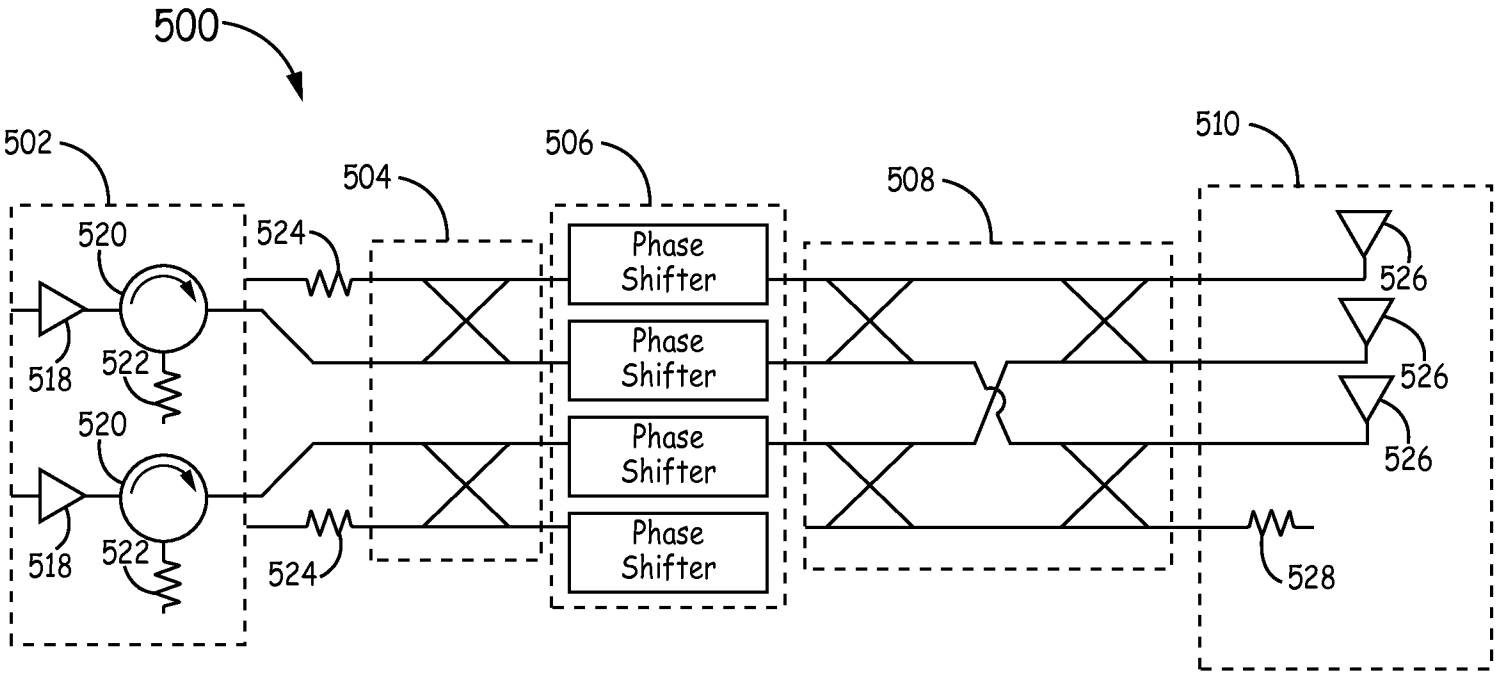

FIG. 5 is a schematic illustrating a combining/switching system 500 having two inputs and three outputs. Thus, as compared to system 100, M=2 and N=3. Further, system 500 includes inputs 502, power dividers 504, phase shifters 506, Butler matrix 508, and outputs 510, which are exemplary implementations of inputs 102, power dividers 104, phase shifters 106, Butler matrix 108, and outputs 110 as described above in relation to system 100 in FIG. 1.

In certain implementations, the system 500 receives two inputs 502 from two separate TWTAs 518. Each output of each TWTA 518 is connected to a ferrite circulator, which circulates the signal towards the power dividers 504. Each input 502 is connected to a power divider 504 that divides the signal into two different branches in a similar manner as described with relation to power dividers 204 in FIG. 2. Each input to the power divider 504 connects to N/M different phase shifters. As N=3 and M=2, the power dividers 504 each divide the power from a single input 502 into two signals and provide the signals having the divided power to two different phase shifters 506. As shown there are two sets of power dividers 504, where each set of power dividers 504 is associated with a different input 502. As further illustrated, each of the 3 dB couplers in the power dividers 504 have one connection terminated with a load 524. In a similar manner, the circulators 520 also have a connection terminated with a load 522. The loads 522 and 524 may be matched loads that absorb signals to prevent the propagation of reflected signals within the combining/switching system 500. As shown in FIG. 5, the arrangement of power dividers 504, where power from one of the two inputs is only divided to two of the four phase shifters 506 permits the use of less 3 dB couplers when compared to a system that divides the power from each input amongst all of the different phase shifters 506.

In a further implementation, the phase shifters 506 may be configurable to control the phase shift to be either 0 or 180 degrees. As understood by one having skill in the art, by controlling the shifts performed by the phase shifters 506, the system 500 is able to control the manner in which the different signals combine within the 4×4 Butler matrix 508 in a similar manner as described above in relation to the 4×4 Butler matrix 208 in FIG. 2. By controlling how the signals combine in the Butler matrix 508, the signals can be routed to a particular output 510. Further, system 500 only provides 3 outputs as one of the outputs from the 4×4 Butler matrix 508 is terminated with a matching load 528. Further, the remaining outputs 510 may each be connected to antennas 526. Thus, the phase shifters 506 and Butler matrix 508, after receiving the different signals from the power dividers 504, are able to combine and/or switch signals received from the inputs 502 towards a particular output 510 in a 2 to 3 combining and switching matrix where one of the outputs 510 is terminated by a load 528. Also, when pairs of outputs are terminated with matching loads 528, as in a 4 input to 6 output combining scheme, some of the 3 dB couplers in the Butler matrix 508 may be removed, and a 3 dB coupler with two matching loads 528 could be replaced with a single matching load 528.

Figure 6:
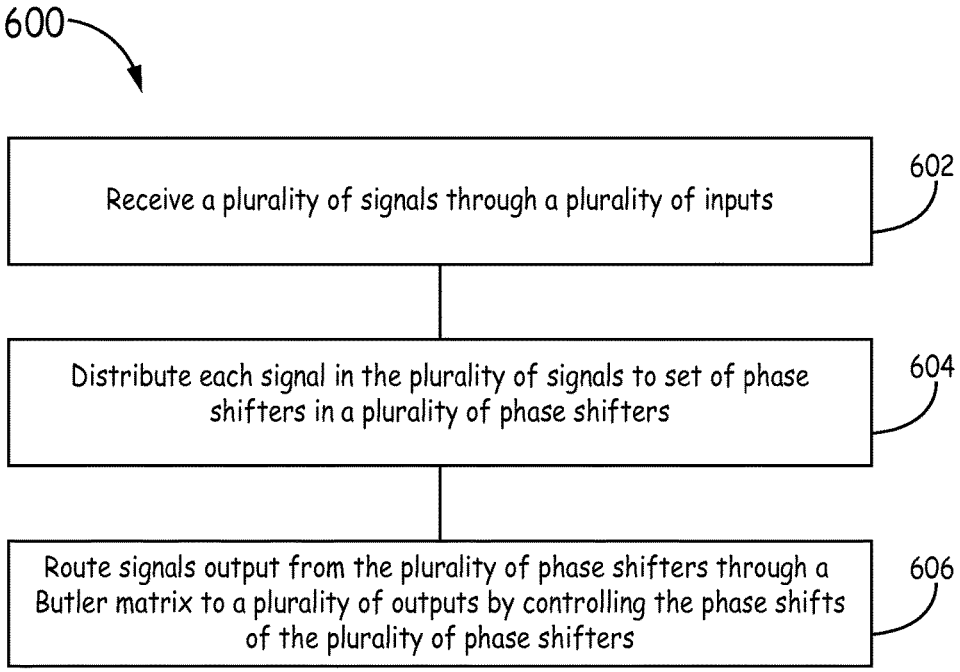
FIG. 6 is a flow diagram of a method for high power microwave combining and switching in one embodiment described in the present disclosure.

FIG. 6 is a flow diagram of a method 600 for switching and combining a signal. In certain embodiments, method 600 proceeds at 602, where a plurality of signals are received through a plurality of inputs. For example, multiple TWTAs may provide inputs that are intended to be combined and routed to a specific antenna in an antenna array. Accordingly, the method 600 proceeds at 604, where each signal in the plurality of signals is distributed to a set of phase shifters in a plurality of phase shifters. In particular, when a signal is distributed to a set of phase shifters, there are a multiple of two times as many phase shifters in the plurality of phase shifters as there are inputs in the plurality of inputs. Further, the number of phase shifters in the set of phase shifters is equal to the number of phase shifters in the plurality of phase shifters divided by the number of inputs in the plurality of inputs.

In at least one embodiment, method 600 proceeds at 606 where signals output from the plurality of phase shifters are routed through a Butler matrix to a plurality of outputs by controlling the phase shifts of the plurality of phase shifters. In at least one implementation, the outputs are coupled to antennas in an antenna array and the signals are routed through the Butler matrix to a particular antenna in the antenna array. By combining the signals as described above, the combining and routing of the signals may be performed with fewer components and fewer crossing waveguides. Thus, systems made accordingly may be made less expensive, lower in mass, and smaller in size.

EXAMPLE EMBODIMENTS

Example 1 includes a system, the system comprising: a plurality of inputs, wherein there are M inputs in the plurality of inputs; a plurality of phase shifters, wherein there are N phase shifters in the plurality of phase shifters and N is a multiple of two times M, wherein a signal received through the plurality of inputs is divided and coupled to N/M phase shifters; and an N:N Butler matrix coupled between outputs of the N phase shifters in the plurality of phase shifters and a plurality of outputs.

Example 2 includes the system of Example 1, wherein the plurality of outputs comprises N outputs.

Example 3 includes the system of any of Examples 1-2, wherein the plurality of outputs comprises less than N outputs and an output of the N:N Butler matrix that is not coupled to an output in the plurality of outputs is terminated with a matched load.

Example 4 includes the system of Example 3, wherein the N:N Butler matrix is altered to remove 3 dB couplers that route signals to pairs of matched loads.

Example 5 includes the system of any of Examples 1-4, wherein a signal received through the plurality of inputs is divided by one or more 3 dB couplers, wherein one input of the 3 dB coupler is coupled to a matched load and another input is coupled to one of an input in the plurality of inputs or an output from another 3 dB coupler.

Example 6 includes the system of any of Examples 1-5, wherein the plurality of inputs receive signals from a plurality of travelling wave tube amplifiers.

Example 7 includes the system of any of Examples 1-6, wherein the plurality of outputs connect to a plurality of antennas in an antenna array.

Example 8 includes the system of Example 7, wherein the plurality of phase shifters are controllable to route the propagation of signals through the N:N Butler matrix to specific antennas in the plurality of antennas.

Example 9 includes a method for combining signals, the method comprising: receiving a plurality of signals through a plurality of inputs; distributing each signal in the plurality of signals to a set of phase shifters in a plurality of phase shifters, wherein there are a multiple of two times as many phase shifters in the plurality of phase shifters as there are inputs in the plurality of inputs and the number of phase shifters in the set of phase shifters is equal to the number of phase shifters in the plurality of phase shifters divided by the number of inputs in the plurality of inputs; and routing signals output from the plurality of phase shifters through a Butler matrix to a plurality of outputs by controlling the phase shifts of the plurality of phase shifters.

Example 10 includes the method of Example 9, wherein the number of outputs in the plurality of outputs is less than the number of phase shifters in the plurality of phase shifters and an output of the Butler matrix that is not coupled to an output in the plurality of outputs is terminated with a matched load.

Example 11 includes the method of Example 10, wherein the Butler matrix is altered to remove 3 dB couplers that route signals to pairs of matched loads.

Example 12 includes the method of any of Examples 9-11, wherein distributing each signal in the plurality of signals comprise routing the signal through one or more 3 dB couplers, wherein one input of the 3 dB coupler is coupled to a matched load and another input is coupled to one of an input in the plurality of inputs or an output from another 3 dB coupler.

Example 13 includes the method of any of Examples 9-12, wherein the plurality of signals are received from a plurality of travelling wave tube amplifiers.

Example 14 includes the method of any of Examples 9-13, further comprising providing the signals to a plurality of antennas in an antenna array, wherein the plurality of outputs connect to the plurality of antennas.

Example 15 includes the method of Example 14, wherein the signals output from the plurality of phase shifters are routed to specific antennas in the plurality of antennas.

Example 16 includes a combining and switching system, the system comprising: a plurality of inputs, wherein the plurality of inputs receive radio frequency signals; a plurality of power dividers coupled to the plurality of inputs; a plurality of phase shifters, wherein there are a multiple of two times as many phase shifters in the plurality of phase shifters as there are inputs in the plurality of inputs, wherein each power divider in the plurality of power dividers distributes a signal received through an input in the plurality of inputs to a set of phase shifters, wherein the number of phase shifters in the set of phase shifters is equal to the number of phase shifters in the plurality of phase shifters divided by the number of inputs in the plurality of inputs; a Butler matrix coupled to outputs for the plurality of phase shifters, wherein the Butler matrix routes signals received from the phase shifters to a plurality of outputs.

Example 17 includes the system of Example 16, wherein the number of outputs in the plurality of outputs is less than the number of phase shifters in the plurality of phase shifters and an output of the Butler matrix that is not coupled to an output in the plurality of outputs is terminated with a matched load.

Example 18 includes the system of any of Examples 16-17, wherein a signal received through the plurality of inputs is divided by one or more 3 dB couplers, wherein one input of the 3 dB coupler is coupled to a matched load and another input is coupled to one of an input in the plurality of inputs or an output from another 3 dB coupler.

Example 19 includes the system of any of Examples 16-18, wherein the plurality of inputs receive signals from a plurality of travelling wave tube amplifiers.

Example 20 includes the system of any of Examples 1-19, wherein the plurality of outputs connect to a plurality of antennas in an antenna array, wherein the plurality of phase shifters are controllable to route the propagation of signals through the Butler matrix to specific antennas in the plurality of antennas.

Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

What is claimed is:

1. A system, the system comprising:

a plurality of inputs, wherein there are M inputs in the plurality of inputs;

a plurality of power dividers, wherein there are M power dividers in the plurality of power dividers;

a plurality of phase shifters, wherein there are N phase shifters in the plurality of phase shifters and N is a multiple of two times M, wherein the plurality of power dividers are configured to divide and couple signals received by the plurality of inputs to respective N/M phase shifters of the plurality of phase shifters such that each phase shifter in the plurality of phase shifters only receives signals from the respective input and wherein the phase shifters of the plurality of phase shifters are configured to be controllable to either a reference phase state 0° or a reference phase state 180°;

a plurality of outputs; and an N:N Butler matrix coupled between outputs of the N phase shifters in the plurality of phase shifters and the plurality of outputs, wherein each of the outputs of the N phase shifters is coupled to an input of the N:N Butler matrix.

2. The system of claim 1, wherein the plurality of outputs comprises N outputs.

3. The system of claim 1, wherein a signal received through the plurality of inputs is divided by one or more 3 dB couplers, wherein one input of the 3 dB coupler is coupled to a matched load and another input is coupled to one of an input in the plurality of inputs or an output from another 3 dB coupler.

4. The system of claim 1, wherein the plurality of inputs receive signals from a plurality of travelling wave tube amplifiers.

5. The system of claim 1, wherein the plurality of outputs connect to a plurality of antennas in an antenna array.

6. The system of claim 5, wherein the plurality of phase shifters are controllable to route the propagation of signals through the N:N Butler matrix to specific antennas in the plurality of antennas.

7. A method for combining signals, the method comprising:

receiving a plurality of signals through a plurality of inputs;

distributing each signal in the plurality of signals to a set of phase shifters in a plurality of phase shifters, wherein there are a multiple of two times as many phase shifters in the plurality of phase shifters as there are inputs in the plurality of inputs and the number of phase shifters in the set of phase shifters is equal to the number of phase shifters in the plurality of phase shifters divided by the number of inputs in the plurality of inputs, wherein each phase shifter in the plurality of phase shifters only receives a distributed signal from one input, wherein the phase shifters (106) are configured to be controllable to either a reference phase state 0° or to a reference phase state 180°; and routing signals output from the plurality of phase shifters through a Butler matrix to a plurality of outputs by controlling the phase shifts of the plurality of phase shifters.

8. The method of claim 7, wherein distributing each signal in the plurality of signals comprise routing the signal through one or more 3 dB couplers, wherein one input of the 3 dB coupler is coupled to a matched load and another input is coupled to one of an input in the plurality of inputs or an output from another 3 dB coupler.

9. The method of claim 7, wherein the plurality of signals are received from a plurality of travelling wave tube amplifiers.

10. The method of claim 7, further comprising providing the signals to a plurality of antennas in an antenna array, wherein the plurality of outputs connect to the plurality of antennas.

11. The method of claim 10, wherein the signals output from the plurality of phase shifters are routed to specific antennas in the plurality of antennas.

12. A combining and switching system, the system comprising:

a plurality of inputs, wherein the plurality of inputs receive radio frequency signals;

a plurality of power dividers coupled to the plurality of inputs;

a plurality of phase shifters, wherein there are a multiple of two times as many phase shifters in the plurality of phase shifters as there are inputs in the plurality of inputs, wherein each power divider in the plurality of power dividers distributes a signal received through an input in the plurality of inputs to a set of phase shifters, wherein the number of phase shifters in the set of phase shifters is equal to the number of phase shifters in the plurality of phase shifters divided by the number of inputs in the plurality of inputs, wherein each phase shifter in the plurality of phase shifters only receives a distributed signal from one input in the plurality of inputs, wherein the phase shifters are configured to be controllable to either a reference phase state 0° or to a reference phase state 180°;

a Butler matrix coupled to outputs for the plurality of phase shifters, wherein the Butler matrix routes signals received from the phase shifters to a plurality of outputs.

13. The system of claim 12, wherein a signal received through the plurality of inputs is divided by one or more 3 dB couplers, wherein one input of the 3 dB coupler is coupled to a matched load and another input is coupled to one of an input in the plurality of inputs or an output from another 3 dB coupler.

14. The system of claim 12, wherein the plurality of inputs receive signals from a plurality of travelling wave tube amplifiers.

15. The system of claim 12, wherein the plurality of outputs connect to a plurality of antennas in an antenna array, wherein the plurality of phase shifters are controllable to route the propagation of signals through the Butler matrix to specific antennas in the plurality of antennas.

* * * * *